United States Patent [19]

Fischer et al.

[11] Patent Number: 4,950,137

[45] Date of Patent: Aug. 21, 1990

[54] RADIAL PISTON MACHINE HAVING PIVOTED CONTROL MEANS ENGAGING CAM RING

[75] Inventors: Horst Fischer, Lohr; Günter Fischer, Gemünden; Rainer Knöll, Burgsinn, all of Fed. Rep. of Germany

[73] Assignee: Mannesmann Rexroth GmbH, Lohr, Fed. Rep. of Germany

[21] Appl. No.: 222,703

[22] Filed: Jul. 21, 1988

[30] Foreign Application Priority Data

Jul. 30, 1987 [DE] Fed. Rep. of Germany ..... 3725353

[51] Int. Cl.[5] ..... F01C 21/16

[52] U.S. Cl. ..... 418/26; 418/27; 418/30

[58] Field of Search ..... 418/24–27, 418/30, 31; 417/219–221; 91/497; 92/12.1

[56] References Cited

U.S. PATENT DOCUMENTS

| | | | |
|---|---|---|---|
| 2,433,484 | 12/1947 | Roth | 418/26 |
| 3,117,528 | 1/1964 | Rosaen | 418/26 |
| 4,780,069 | 10/1988 | Dantlgraber et al. | 418/26 |

FOREIGN PATENT DOCUMENTS

| | | | |
|---|---|---|---|
| 2500618 | 7/1976 | Fed. Rep. of Germany | 418/26 |
| 3429542 | 2/1986 | Fed. Rep. of Germany | 417/219 |
| 3429935 | 2/1987 | Fed. Rep. of Germany . | |
| 59-173588 | 10/1984 | Japan | 418/27 |

*Primary Examiner*—John J. Vrablik

*Attorney, Agent, or Firm*—Cushman, Darby & Cushman

[57] ABSTRACT

The invention relates to a radial piston machine comprising height adjustment means, control means and adjustment means all having abutment means designed such that the cam ring of the machine will carry out during its adjustment a substantially rolling movement.

16 Claims, 8 Drawing Sheets

RADIAL PISTON MACHINE HAVING PIVOTED CONTROL MEANS ENGAGING CAM RING

The invention relates to a radial piston machine and in particular to a vane type machine. The invention relates particularly to a radial piston pump, in particular a vane-type pump.

Machines of the above-mentioned type are known in a great variety of designs. Generally speaking, a radial piston machine comprises a housing, piston means and a cam ring, so as to form compression chambers. Typically, the cam ring is under the influence of a height or level adjustment means, a control means and an adjustment means which is located diametrically opposite to the control means. When, for instance, the machine is operated as a pump, the height adjustment means is used for adjusting the starting point of the compression and the adjustment means will adjust the amount of pressure medium supplied. The control means can be hydraulically actuated, so that a hydraulically controlled pump is provided. Alternatively, the control can be carried out by spring means. Such a pump is called a spring compensated pump. It should be noted in this context that the following description will be primarily directed to radial piston machines in the form of vane type pumps. However, similar remarks are true for the operation of a machine working as a motor.

Typically, the height adjustment means, the control means as well as the adjustment means are in engagement or abutment with the cam ring by means of engagement or abutment means. As a result thereof, the known radial piston machines show a large degree of friction and wear and consequently hysteresis.

German Pat. No. 34 29 935 discloses a radial piston machine according to which a cam ring fixed in the area of the height adjustment means can be influenced by piston means, including pivot piston means as well as by springs. For instance, in FIG. 5 of said patent a pivot piston is used in an adjustment means. This pivot piston is in engagement with a bore of the cam ring, so that between the piston and the cam ring a "boring" friction occurs which has an unfavorable effect on the hysteresis of the pump. Moreover, the cam ring is fixed in the area of the height adjustment screw. This will require firstly a recess in the cam ring with the consequence of a reduced strength and higher costs. Secondly, a frictional rolling movement will be caused between the adjustment screw of the adjustment means and the cam ring, so that the hysteresis of the pump is negatively influenced.

It is an object of the present invention to overcome the problems of the prior art. It is another object of the present invention to provide a hydraulic machine, particularly a vane type pump such that the disadvantages of the prior art are overcome and that a reduced hysteresis and, consequently, a reduced wear is achieved.

BRIEF DESCRIPTION OF THE DRAWINGS

Additional advantages, objects and details of the invention may be gathered from the following description of embodiments shown in the accompanying drawings, in which:

FIG. 1 discloses a first embodiment of a vane-type pump 1 comprising a housing 2 within which a cam ring 3 is located, as is well known in the art. Within the cam ring 3 a rotor 4 is located on a rotor shaft 5 which, in turn, rotates about the longitudinal axis 6 of the pump 1. In FIG. 1 the direction of rotation is marked by arrow 7. The rotor 4 carries a plurality of vanes 8 which are in engagement with the inner surface 9 of the cam ring 3, thus forming compression chambers. The outer surface 10 of the cam ring 3 is subjected to the influence of a level or height adjustment means 12, a control means 13 and an adjustment means 14.

In addition to the already mentioned longitudinal axis 6 a transverse axis 17 and a vertical pump axis 18 are defined. The vertical axis of the cam ring 3 is referred to by reference numeral 19. FIG. 1 shown the cam ring 3 in its condition of maximum excentricity such that the vertical axis 18 of the pump has the shown small distance 15 with respect to the vertical axis 19 of the cam ring 3.

Figure 1:
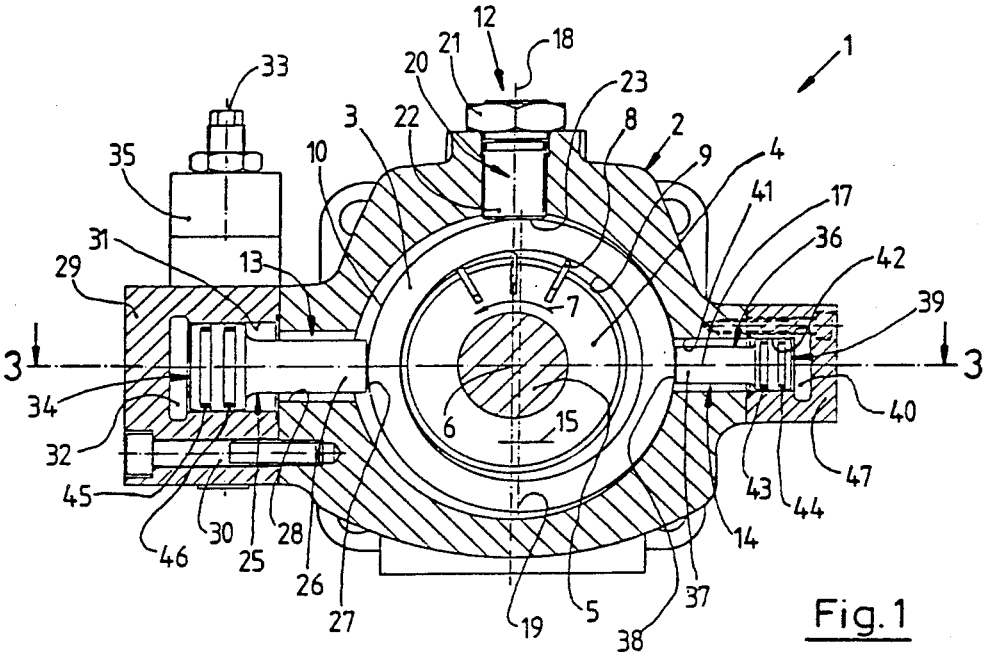
FIG. 1 is a cross-sectional view substantially along line 1—1 in FIG. 3 of a vane-type pump of the invention with the cam ring being shown in its condition of maximum excentricity.

Before continuing with the description the reader is reminded that the present invention is described here in connection with a pump, specifically a vane-type pump. However, the invention relates generally to radial piston type machines.

The height adjustment means 12 comprises a height adjustment screw 20 which can be screwed into the housing 2 for engagement with the cam ring 3. The height adjustment screw 20 can be secured in any adjusted position by means of a securing nut 21. Moreover, the height adjustment screw 20 forms abutment means 22 which, in turn, comprise an abutment surface 23. The abutment surface 23 is, in accordance with the invention, of planar design. The plane defined by the abutment surface 23 extends parallel to the transverse axis 17 of the pump. Thus, the cam ring is in no way locked by the height adjustment screw 20.

The control means 13 comprises a pivotably mounted piston (pivotal piston) 25 which is located in a bore 28 of the housing and a bore 31 of a member 29 fixedly mounted to said housing 2. The pivotal piston 25 forms an abutment means 26 which, in turn, defines an abutment surface 27 serving as an abutment for the cam ring 3. The abutment surface 27 is planar, so that the cam ring 3 basically can roll on the abutment surface 27. Screws 30 are used to mount member 29 to housing 2.

Bore 31 forms a pressure medium chamber 32 which is supplied with pressure medium by means of a control apparatus (supply member) 35. The supply of pressure medium is carried out in detail by a pressure adjustment means 33 located in the supply member 35 of member 29.

Figure 2:
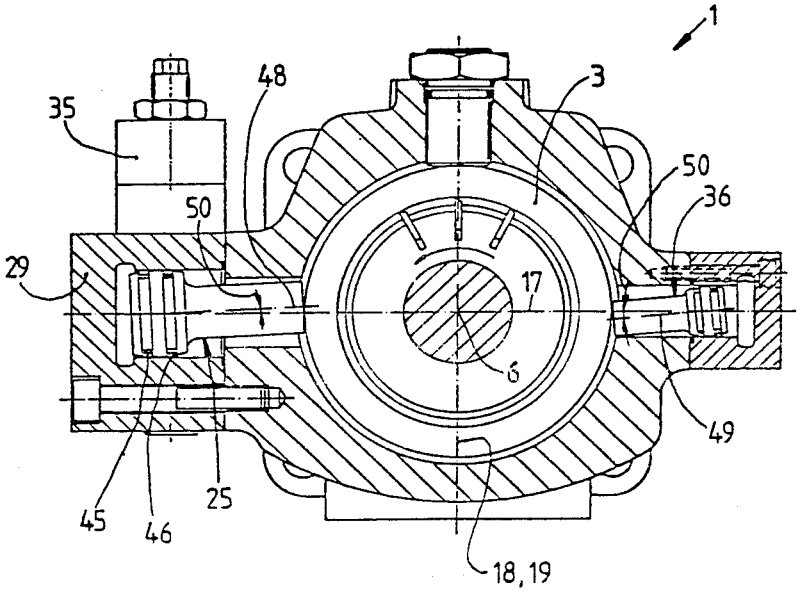
FIG. 2 is a cross-sectional view similar to FIG. 1 with the cam ring being shown in its condition of zero excentricity.

The pivotal piston 25 is provided at its end opposite to the abutment surface 27 with a piston head 34 such that the piston 25 can be pivoted from its position shown in FIG. 1 into a pivot position shown in FIG. 2.

The adjustment means 14 comprises also a pivotable piston (pivot piston) 36 which comprises at its end facing towards the cam ring 3 an abutment surface 38. Said abutment surface 38 is planar so that basically the cam ring 3 can roll on said abutment surface 38 during its movement. Said abutment surface 38 is formed on abutment means 36 provided by the pivot piston 36. The pivot piston 36 comprises at its end opposite to the abutment surface 38 a piston head 39 which, in turn, comprises three lands and two grooves adapted to receive piston rings (seals) 43 and 44. It should be noted in this context that pivot piston 25 also comprises at its pivot or piston head 34 three lands with two grooves placed inbetween and adapted to receive piston rings (seals) 45 and 46.

The pivot piston 36 is arranged in a housing bore 41 and ends with its head in a bore 42 of a guide element (member) 47 fixedly mounted to the housing 2.

As already mentioned, cam ring 3 is shown in FIG. 1 in its condition of maximum excentricity. The longitudinal axes of the pivot piston 25 and also of the pivot piston 36 are located, for instance, on transverse axis 17.

In FIG. 2 the cam ring 3 is shown in its condition of zero excentricity, i.e. the longitudinal axis of the pivot piston 25 is pivoted "upwardly" with respect to the transverse axis 17 by a small angle 50, while the longitudinal axis 49 of the pivot piston 36 is "downwardly" pivoted with respect to said transverse axis 17. In accordance with the invention the transition from the position of FIG. 1 to the position of FIG. 2 and vice-versa occurs in substance only by a rolling movement of the cam ring 3 on the abutment surfaces 23, 27 and 38. The result is an extremely low hysteresis.

In the embodiment shown in FIG. 1 the pivot pistons 25 and 36 are not biased by means of springs. Preferably, however, pivot piston 25 is biased by spring means, not shown, into abutment at or engagement with the cam ring 3.

Both, the pivot piston 25 as well as the pivot piston 36 are under the influence of hydraulic pressure medium which is supplied in a manner known per se to a pressure space 32 and 40, respectively.

Figure 3:
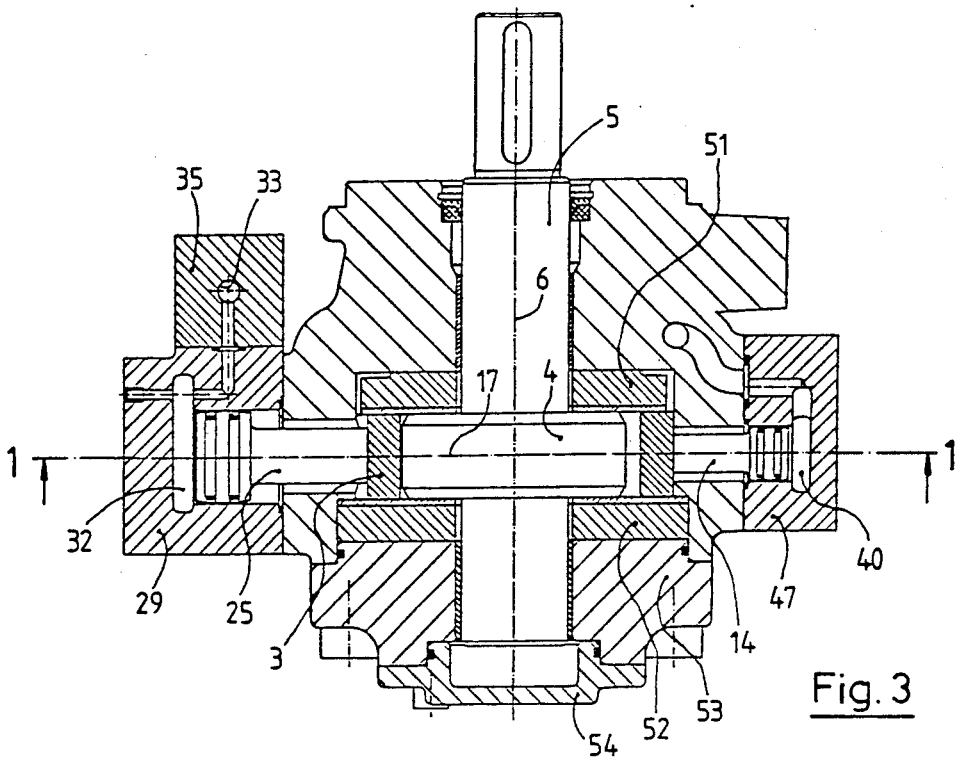
FIG. 3 is a sectional view along line 3—3 in FIG. 1.

FIG. 3 shows some additional details of the embodiment of FIGS. 1 and 2. FIG. 3 showns in detail how the pressure medium is supplied to pressure medium chamber 32 via control means 35. In a manner known per se, two discs 51 and 52 are provided adjacent to the rotor 4 and the cam ring 3, and a cover member 53 closes the housing 2 and is, in turn, covered by a lid 54.

Figure 4:
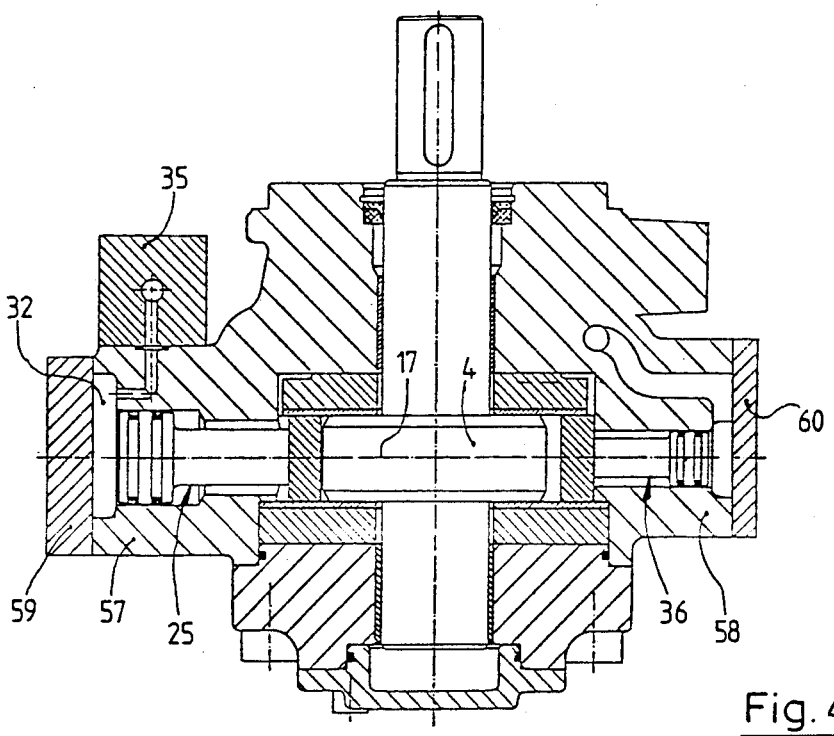
FIG. 4 is a sectional view similar to FIG. 3 of a second embodiment of the invention.

FIG. 4 discloses a second embodiment of the invention which is similar to the embodiment of FIG. 1. In accordance with FIG. 4 the members 29 and 47 shown in FIG. 1 are part of the housing, i.e. for all practical purposes housing extensions 57 and 58 respectively. Said housing extensions 57, 58 are closed by lids 59 and 60, respectively. Otherwise reference is made to the description of the embodiment of FIGS. 1–3.

Figure 5:
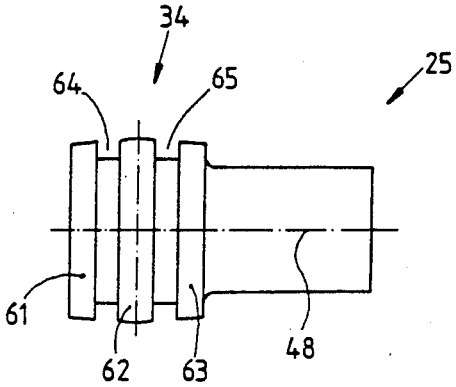
FIG. 5 is a partial view of a pivotable piston of the invention as used in the embodiment of FIG. 1.

FIG. 5 is a partial side view of the pivot piston 25. It can be clearly recognized that in the area of the piston head 34 three lands 61, 62, 63 are formed with grooves 64 and 65 arranged therebetween. Into said grooves 64 and 65 seals will be inserted.

Figure 6:
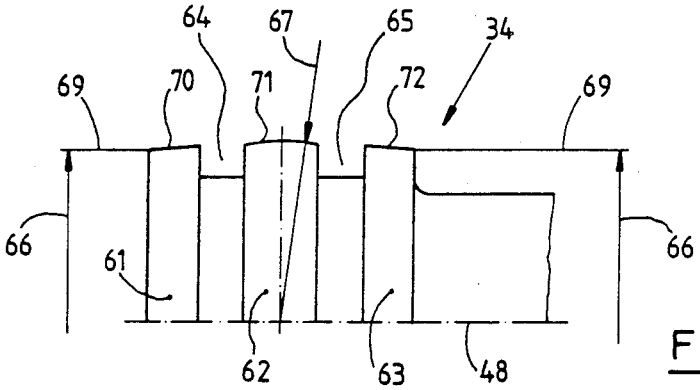
FIG. 6 shows a detail of FIG. 5.

FIG. 6 discloses a detail of the piston head 34. The longitudinal axis 48 of the piston 25 can be seen and it should further be noted that a radius 66 defines a line or, more precisely, a circular cylinder 69. Land 61 forms an abutment surface 70 which is inclined with respect to line or cylinder 69 by a small angle of approximately 3°. The same is true for the abutment surface 72 of land 63, but here the angular inclination (again 3 degrees) is opposite to the inclination of abutment surface 70. The abutment surface 71 of land 62 is formed by a circular arc having a radius 67. Radius 67 is a little bit larger than radius 66.

Figure 7:
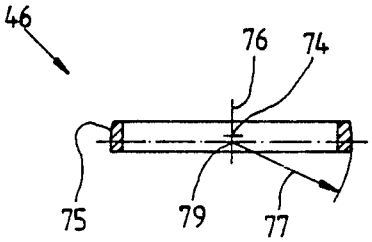
FIG. 7 is a cross-sectional view of a piston of seal ring of the invention as used in a machine of FIG. 1.
Figure 8:
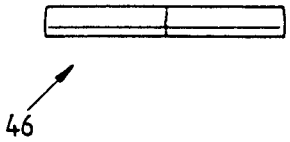
FIG. 8 is a side view of the seal ring of FIG. 7.

In FIG. 7 a piston or seal ring 46 is shown. Piston rings 46 of this type are adapted to be inserted into the two grooves 64 and 65. FIG. 8 is a side view and FIG. 7 a cross-sectional view of the piston ring 46. The center axis of the piston ring 46 is referred to by reference numeral 76. The abutment surface 75 of the seal or piston ring 46 is defined by a circular arc having the radius 77. The center 79 of the circle having the radius 77 is a little bit offset with respect to the center 74 (see FIG. 7), so that the hatched cross-sectional area is slightly asymmetrical.

Figure 9:
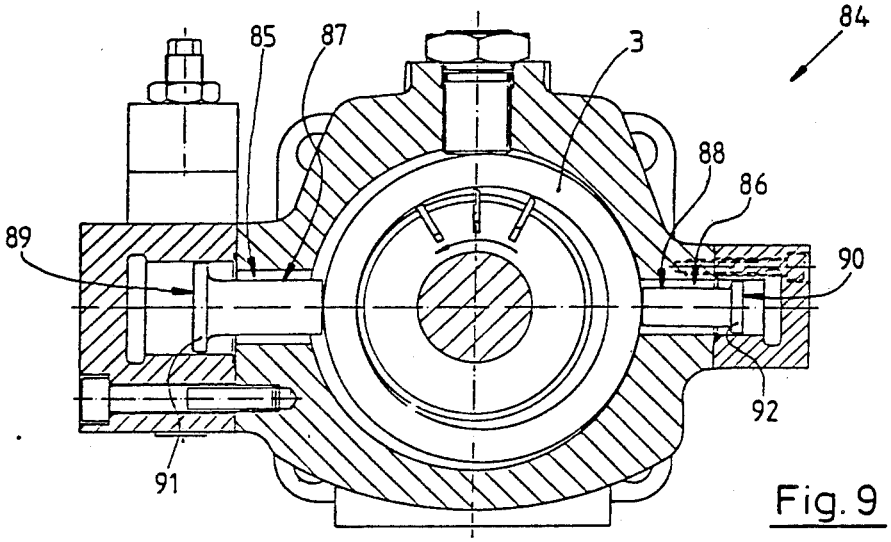
FIG. 9 is a sectional view similar to FIG. 1 of a third embodiment of a pump of the invention.

FIG. 9 discloses a third embodiment of a vane-type pump 84 or the invention. The vane-type pump 84 differs from the vane-type pump of FIG. 1 only in so far as the control means 85 and the adjustment means 86 are of different design. Specifically, the pivot piston 87 of the control means 85 and also the pivot piston 88 of the adjustment means 86 are of a simpler design than the comparable pivot pistons of the embodiment of FIG. 1. Pivot piston 87 comprises a piston head 89 which, for all practical purposes, forms a single land 91 and does not comprise any additional sealing means. Similarly, the piston head 90 of the pivot piston 88 comprises only a single land 92. Lands 91 and 92 have a shape similar to land 62 in FIG. 6, as is apparent from the depiction of the lands in FIG. 9. This is a less complicated design.

Even though not shown in FIG. 9, it is possible to bias pivot piston 87 and/or pivot piston 88 by spring means towards the cam ring 3.

Figure 10:
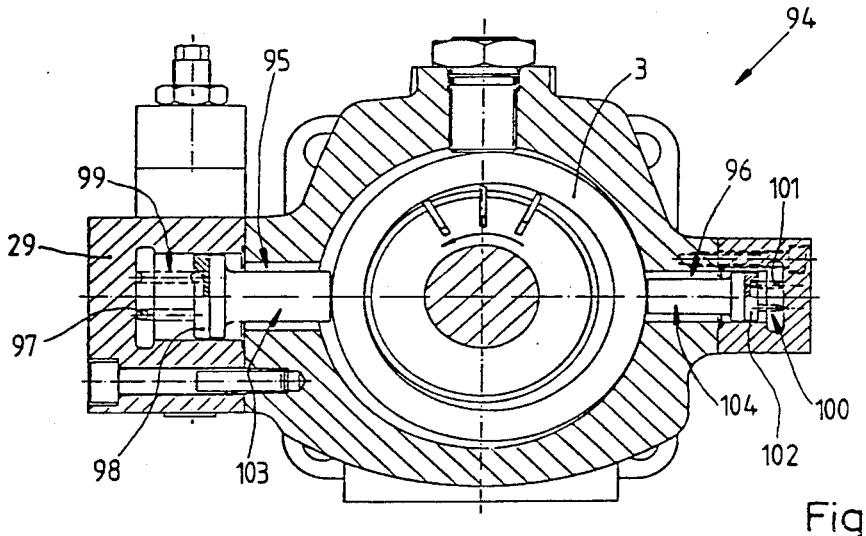
FIG. 10 is a cross-sectional view of a fourth embodiment of a pump similar to the embodiment of FIG. 9.

FIG. 10 discloses a fourth embodiment of a vane-type pump 94 similar to the pump shown in FIG. 9. In the embodiment of FIG. 10 the control means 95 comprises a pivot piston 103 similar to the pivot piston 87 of FIG. 9. Further an adjustment means 96 is provided with a pivot piston 104 similar to the pivot piston 88.

In addition, control means 95 comprises a spring arrangement 99 which biasses the pivot piston 103 against cam ring 3. The spring arrangement 99 comprises, in turn, a spring 97 which abuts on the one-hand side at member 29 and on the other side at a pivotable seal element 98. The pivotable seal element 98 is in abutment with the piston head of the pivot piston 103.

Similarly, the adjustment means 96 is provided with a spring arrangement 100 comprising a spring 101 as well as a pivotable seal element 102.

Figure 11:
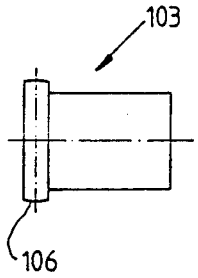
FIG. 11 is a side view of a pivotable piston used in the embodiment of FIG. 10.

In FIG. 11 a side view of the pivot piston 103 is shown comprising only a single land which is crowned (rounded) at its outer circumference as referred to by reference numeral 106.

Figure 12:
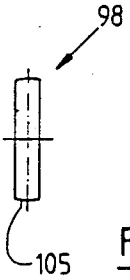
FIG. 12 is a side view of a pivotable sealing element as is used in the embodiment of FIG. 10.

As is shown in FIG. 12 the pivotable seal element 98 is also crowned (rounded) at its outer circumference as is shown by reference numeral 105.

Figure 13:
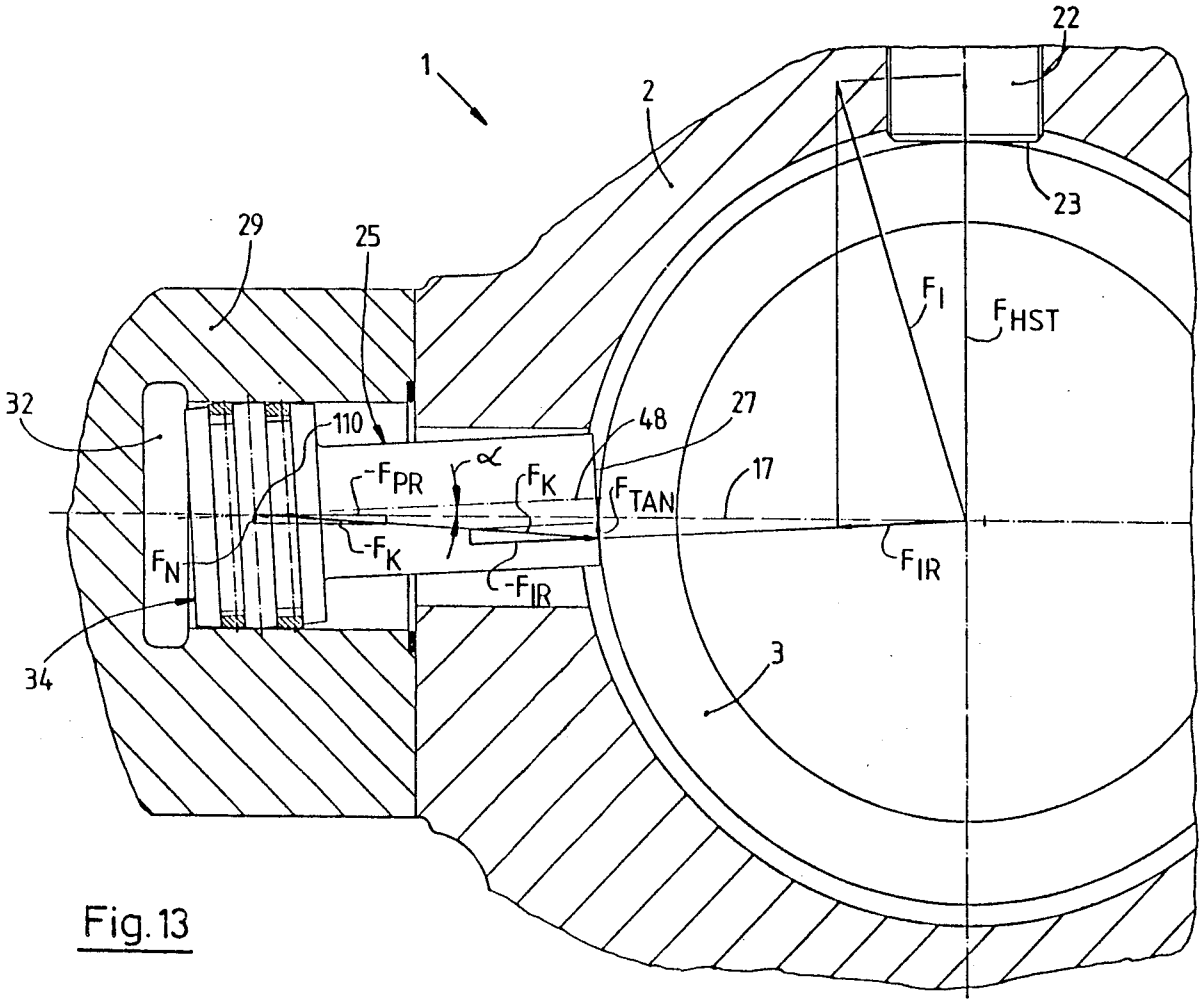
FIG. 13 is a schematic representation of a part of the pump of FIG. 1 used to explain the operation.
Figure 14:
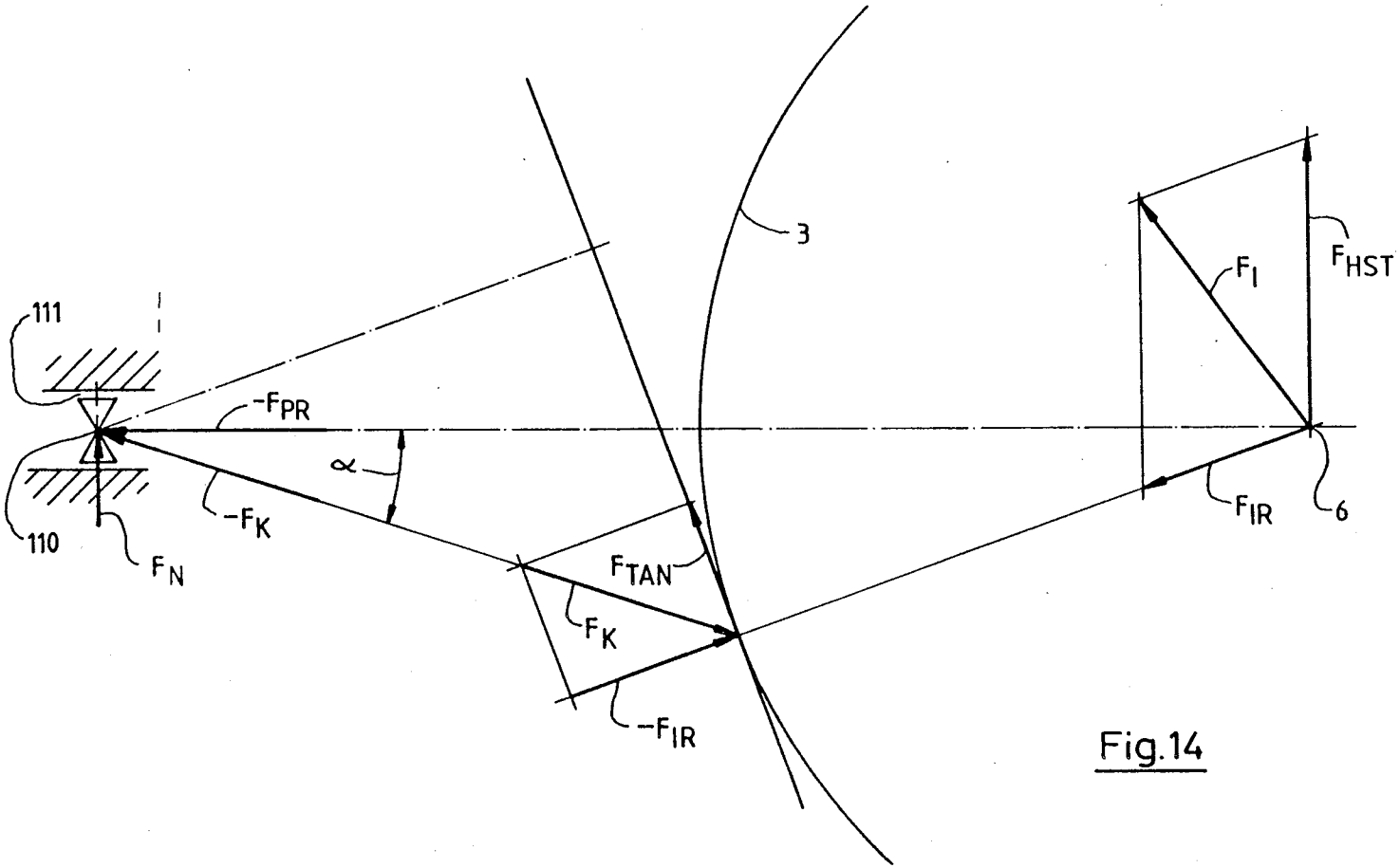
FIG. 14 is a schematic representation of the force situation for a pump of FIG. 13.

Referring now to FIGS. 13 and 14 the operation of the embodiment shown in FIGS. 1–3 will be explained. This description applies mutatis mutandis to the other embodiments also.

FIGS. 13 and 14 show pump 1 in its operating condition of FIG. 2, i.e. the condition where the cam ring has no or zero excentricity with respect to the rotor. In this condition the amount of pressure medium supplied by the pump is, for all practical purposes, zero. In contrast thereto, in the operating condition shown in FIG. 1 the cam ring is located in its condition of maximum excentricity, such that a maximum amount of pressure medium is supplied. The cam ring can reciprocate betwen said two operating conditions of FIGS. 1 and 2, respectively. In each condition adjusted by the adjustment means the proper control depending on the load will be carried out, as is described, for instance, in German Pat. No. 34 29 935 of the applicant.

It should be noted that FIG. 14 is an exaggeration of what is shown in FIG. 13, so as to make the relationship of the forces even clearer. In both, FIG. 13 and 14, the center of the piston or the center of the ball, i.e. the point about which the piston 25 pivots, is referred to by reference numeral 110. The pivotal movement of piston 25 occurs, for all practical purposes, in a plane perpendicular to the longitudinal axis 6 of the pump (see FIG. 3).

In the situation shown in FIG. 13 pump 1 is in a condition of equilibrium. In such a condition the following forces have to be considered. $F_I$ represents all the inner forces which are caused by the pressures within the pump. The force $F_I$ can be split up into two force components $F_{HST}$ and $F_{IR}$. The force $F_{HST}$ is the force which will be reacted to by the height adjustment screw 22. $F_{IR}$ is the so-called inner resulting force which will be received or reacted against by a force $-F_{IR}$ provided by the pivot piston 25. The force $-F_{IR}$ can be split up into the two components force $F_K$ and $F_{TAN}$. $F_{TAN}$ is the tangentially acting force.

In the condition of equilibrium for any position of the pivotal piston the following equation is true $$F_{TAN}=F_{IR}\text{times } \mu$$

with $\mu$ being the coefficient of friction.

The tangential force $F_{TAN}$ produces a resetting effect as long as the angle alpha between cross or transverse axis 17 and the longitudinal piston axis 48 is larger than zero. For the angle alpha =0 the tangential force $F_{TAN}=0$, i.e. the piston 25 is in its center position shown in FIG. 1.

As long as $F_{IR}$ times $\mu$ is larger than $F_{TAN}$, rolling friction is present. For $F_{IR}$ times $\mu$ smaller $F_{TAN}$ sliding occurs. For a given diameter of the cam ring and for a given amount of excentricity the proportion of the sliding friction can be held small by properly tuning the length of the piston.

In the center 110 of the piston the negative piston force $-F_K$ is acting which can be split up into the force components $F_N$ and $-F_{PR}$. $F_N$ is practically due to the frictional wear in the slide guide means represented by bearing 111. The force $-F_{PR}$ is a force which has to be taken up by the hydraulic pressure in the pressure medium chamber 32.

Figure 15:
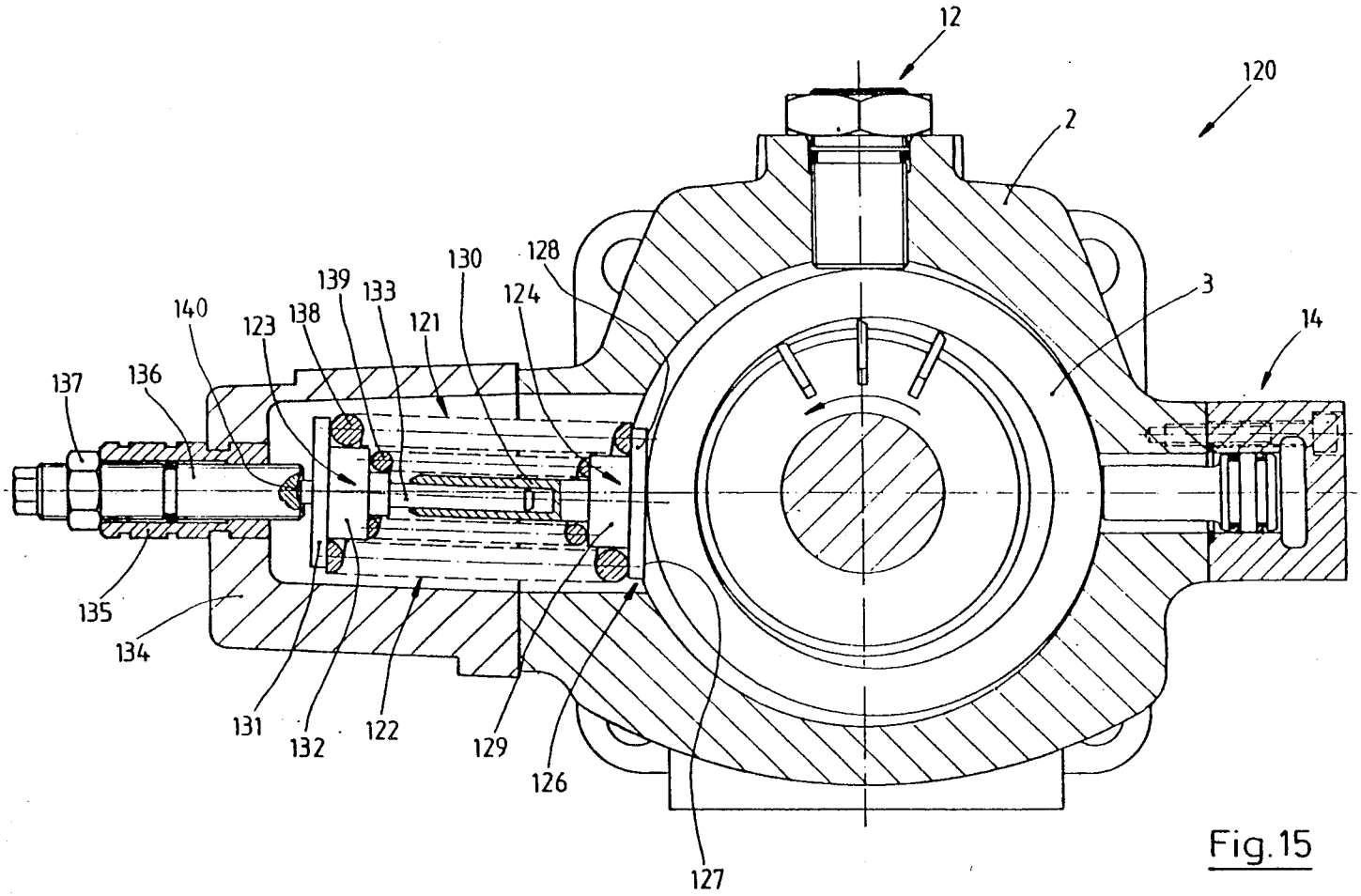
FIG. 15 is a cross-sectional view similar to FIG. 1 of a fifth embodiment of a pump of the invention.

Following the above discription of the operation, attention is drawn to FIG. 15 where a fifth embodiment of a radial piston machine in the form of a vane-type pump 120 is disclosed. Vane-type pump 20 corresponds in substance to pump 1 of FIG. 1, however, for pump 120 the hydraulic control means 13 is replaced by a spring compensation arrangement 121.

The spring compensation 121 comprises a pivot spring arrangement 122 and abutment means 126. The abutment means 126 include a planar (flat) abutment surface 127 on which the cam ring 3 can roll.

The pivot spring arrangement 122 comprises in detail spring receiving elements 123 and 124 between which pivot spring means extend. The pivot spring means are formed, for instance, by two coaxially arranged coil springs 138 and 139. The spring receiving element 123 comprises a pivot or abutment plate 131, an abutment cylinder 132 and a guide pin 133. The components 133, 131 and 132 form, for all practical purposes, a single piece. The same is true for the spring receiving element 124 which comprises abutment plate 128, abutment cylinder 129 and guide 130. Guide 130 is adapted to receive said pin 133.

The pivot plate 131 is supported by means of a pivot bearing 140 at a threaded pin 136 which is screwed into the threads of a thread sleeve 135. As can be seen in FIG. 15, pivot bearing 140 is in the form of a concave recess. The thread sleeve 135 is, in turn, mounted into a cover 134 which is fixedly mounted to housing 2. A securing nut 137 secures the threaded pin 136.

Due to the design of the invention the spring compensation 121 can carry out a pivotal movement about the pivotal bearing 140 such that the cam ring 3 rolls on the abutment surface 127 when a movement of the cam ring 3 from the position of maximum excentricity shown in FIG. 15 to a zero excentricity position shown in FIG. 1 for the pivot piston occurs.

Figure 16:
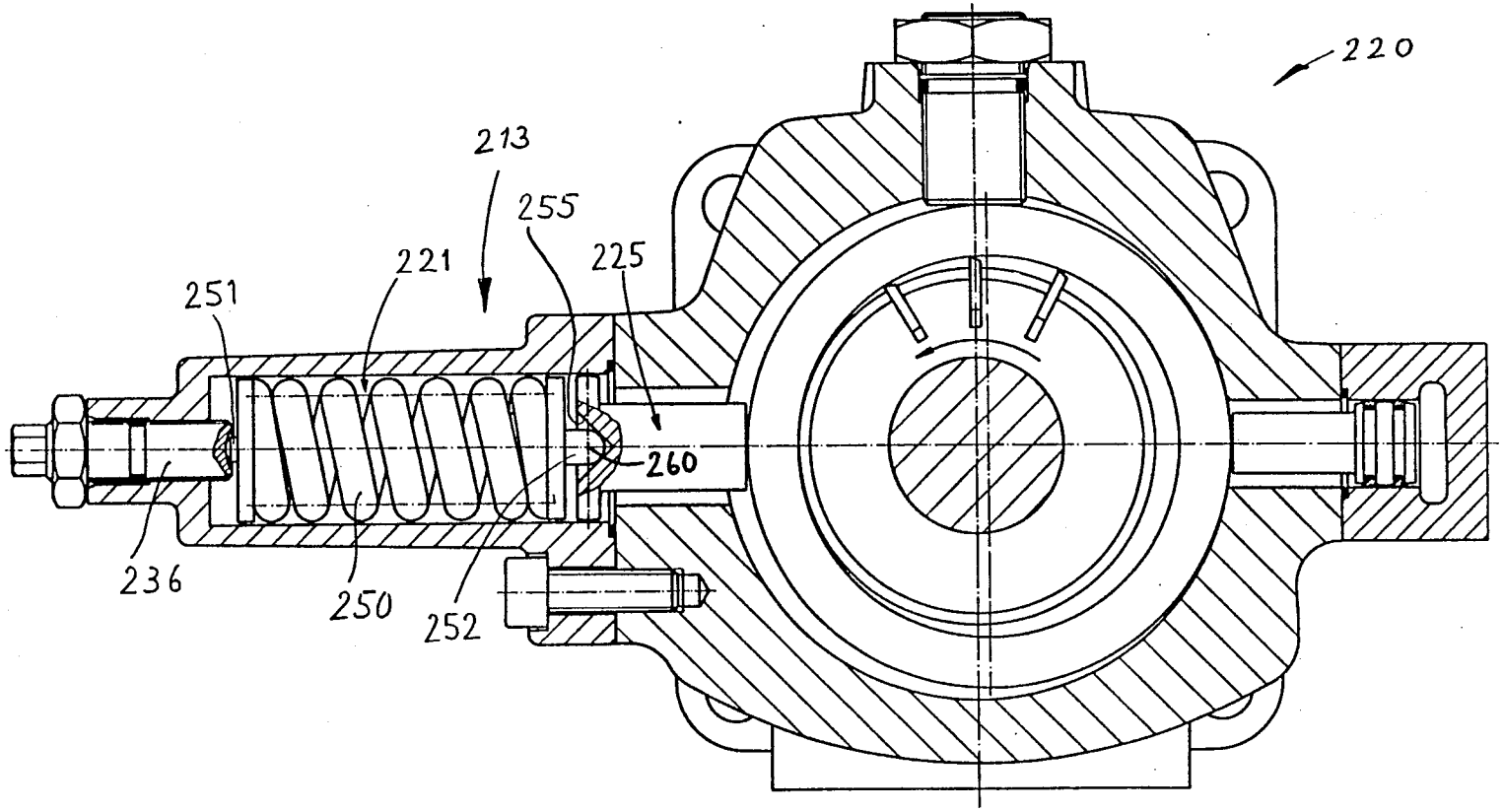
FIG. 16 is a cross-sectional view similar to FIG. 1 of a sixth embodiment of a pump of the invention.

FIG. 16 discloses a sixth embodiment of a vane type pump 220 similar to pump 120 of FIG. 15. Pump 220 uses a spring compensation 221 different from the spring compensation 121 of FIG. 15. Spring compensation 221 acts on a pivot piston 225 which forms together with the spring compensation 221 control means 213. Spring compensation 221 comprises a coil spring 250 which acts between two spring plates having outwardly projecting bearing pins 251, 252. Bearing pin 251 is in engagement with a concave recess defining a bearing surface of a threaded pin 236 of a design similar to the bearing pin 136 of FIG. 15. Pivot piston 225 is of a design similar to piston 103 of FIG. 10 and forms a bearing recess adapted to receive bearing pin 252. With the exception of the bearing surface 255 pivot piston 225 corresponds to piston 103 shown in FIG. 11. As shown in FIG. 16, bearing surface 255 is substantially conically shaped.

The bearing plate carrying the bearing pin 252 is supported in the pivot point 260 of the pivot piston 225.

Summarizing it can be stated that the bearing surfaces of the pistons (for instance piston 25 and piston 36) are planar (flat) in design which simplifies the manufacture of the pistons. Moreover, the bearing surface of the height adjustment screw can be of planar design which again simplifies the manufacture.

It should be further noted that the guide elements 29 and 47 can be manufactured and mounted without any problems.

The use of the pivot piston provides for the compensation of a possible error of angle between guide elements 29 and 47, respectively, and the cross axis 17 and the longitudinal axis 6. Generally speaking, the design of the invention allows easy access for repairs.

During operation of the machine of the invention substantially only rolling movements occur between the cam ring and the control piston as well as the adjustment piston and also with respect to the height adjustment screw. By substantially replacing the slide friction by rolling friction the hysteresis of the pump becomes small. Most of the friction occurs between the cam ring 3 and the side discs 51, 52 (see FIG. 3).

In the disclosed embodiments the pivot pistons will be pivoted during a movement from the position of the cam ring with maximum excentricity to the position of the cam ring with zero excentricity, i.e. the pivot pistons are subjected to a pivotal movement due to the rolling of the cam ring. The design could also be provided in an opposite manner such that the pivot pistons can be in a pivoted position when the cam ring is in its position with maximum excentricity and the movement of the cam ring to the zero excentricity position will bring the pivot pistons into their not pivoted position.

The pivot pistons of the invention can be used together with a control based on addition of pressure as well as based on a reduction of pressure.

We claim:

1. A radial piston machine comprising:

a housing, a cam ring locating in said housing and adjustable in horizontal and vertical direction, a rotor rotatably mounted in said housing and located within said cam ring, pressure chambers formed between said rotor and said cam ring, means for supplying pressure medium and for removing pressure medium, a height adjustment means mounted in said housing and adapted to adjust the height of the cam ring so as to change the beginning of the compression of the machine, said height adjustment means having abutment means for engagement with the cam ring, a control means in engagement with said cam ring by means of abutment means, an adjustment means pivotally mounted in said housing and located substantially diametrically with respect to the control means, wherein said adjustment means is in engagement with said cam ring by means of abutment means, wherein a connecting line of said control means and said adjustment means extends substantially perpendicular to the line of action, along which the height adjustment means transfer a force on to said cam ring, wherein the abutment means of the height adjustment means are stationary for a predetermined adjusted level and comprise in the area of engagement with the cam ring a planar abutment surface such that the cam ring can freely rotate thereon, wherein the abutment means of the control means comprise in the area of the engagement with the cam ring a planar abutment surface such that the cam ring can freely roll thereon, wherein the abutment means of the control means are pivotally mounted in the housing such that for a change of the excentricity of the cam ring the cam ring rolls on the abutment means of the height adjustment means and pivots the abutment means of the control means during said rolling movement, and wherein said abutment means of the adjustment means comprises in the area of engagement with the cam ring a planar abutment surface such that for a change of excentricity of the cam ring the cam ring rolls on the abutment means of the adjustment means and pivots it during said movement.

2. The machine of claim 1 wherein the control means comprises a pivot piston.

3. The machine of claim 1 wherein the adjustment means comprises a pivot piston.

4. The machine of claim 2 wherein the abutment surface is directly formed by the end of the pivot piston.

5. The machine of claim 3 wherein the abutment surface is formed directly by the end of the pivot piston.

6. The machine of claim 2 wherein the pivot piston is subjected at its end opposite to the abutment surface to pressure.

7. The machine of claim 1 wherein the control means is formed by pivotal spring means.

8. The machine of claim 7 wherein the pivotal spring means comprise two oppositely arranged spring receiving elements between which a plurality of springs are arranged, wherein one of said spring receiving elements comprises a planar abutment surface for engagement with the cam ring, while the other spring receiving element is pivotally mounted at the housing or a component connected therewith.

9. The machine of claim 8 wherein in between the spring receiving element a coil spring is arranged.

10. The machine of claim 8 wherein two coil springs are arranged coaxially with respect to each other between said spring receiving elements.

11. The machine of claim 8 wherein the spring receiving element supported by the housing is supported by an adjustment means such that the spring means can be more or less biassed.

12. The machine of claim 2 wherein the pivot piston comprises ring grooves forming lands with piston rings being located in said grooves.

13. The machine of claim 12 wherein the outer surfaces of said lands are rounded such that the pivotal movement is easily possible.

14. The machine of claim 12 wherein three lands and two grooves are provided and the outermost lands are tapered by a small angle and in oppsite directions with respect to a line parallel to the center axis of the piston, while the center land is crowned.

15. The machine of claim 1 wherein said control means is formed by a spring acting on a pivot piston, wherein said spring extends between two spring support plates, one of which abuts against the housing while the other abuts against said pivot piston such that the spring plate which is in abutment with the piston is supported substantially in the area of the pivot point of said pivot piston.

16. The machine of claim 1 wherein the rotor is provided with vanes so as to form a vane-type pump.

* * * * *